US009589573B2

(12) United States Patent
Harvey et al.

(10) Patent No.: US 9,589,573 B2
(45) Date of Patent: Mar. 7, 2017

(54) WIND NOISE REDUCTION

(71) Applicant: Wolfson Dynamic Hearing Pty Ltd., Cremorne, Victoria (AU)

(72) Inventors: Thomas Ivan Harvey, Cremorne (AU); Vitaliy Sapozhnykov, Cremorne (AU)

(73) Assignee: Cirrus Logic International Semiconductor Ltd., Edinburgh (GB)

( * ) Notice: Subject to any disclaimer, the term of this patent is extended or adjusted under 35 U.S.C. 154(b) by 0 days.

(21) Appl. No.: 14/904,365

(22) PCT Filed: Jul. 11, 2014

(86) PCT No.: PCT/AU2014/000714
§ 371 (c)(1),
(2) Date: Jan. 11, 2016

(87) PCT Pub. No.: WO2015/003220
PCT Pub. Date: Jan. 15, 2015

(65) Prior Publication Data

US 2016/0155453 A1 Jun. 2, 2016

(30) Foreign Application Priority Data

Jul. 12, 2013 (AU) ..... 2013902592
Apr. 17, 2014 (AU) ..... 2014901430

(51) Int. Cl.
*G10L 21/0232* (2013.01)
*G10L 25/18* (2013.01)
(Continued)

(52) U.S. Cl.
CPC ..... *G10L 21/0232* (2013.01); *G10L 25/18* (2013.01); *H04R 3/005* (2013.01);
(Continued)

(58) Field of Classification Search
None
See application file for complete search history.

(56) References Cited

U.S. PATENT DOCUMENTS

2007/0058822 A1* 3/2007 Ozawa ..... G10L 21/0208 381/94.1
2008/0317261 A1* 12/2008 Yoshida ..... H04R 3/04 381/94.1
2014/0161271 A1* 6/2014 Teranishi ..... H04R 5/04 381/71.7

FOREIGN PATENT DOCUMENTS

JP 2001352594 A 12/2001

OTHER PUBLICATIONS

International Search Report and Written Opinion, International Patent Application No. PCT/AU2014/000714, mailed Aug. 5, 2014, 9 pages.

* cited by examiner

*Primary Examiner* — Joseph J Nguyen
*Assistant Examiner* — Kenny Truong
(74) *Attorney, Agent, or Firm* — Jackson Walker L.L.P.

(57) ABSTRACT

A method of wind noise reduction. Left side and right side microphone signals are obtained. In a first stage wind noise reduction is applied to a first sub-band of one of the signals, below a spectral threshold $N_A$. In a second stage the wind noise reduced first side signal, and the second side signal, are both split into a sub-band below a threshold $N_B$ less than $N_A$. The sub-band of the first side signal is mixed with the sub-band of the second side signal to produce an aggregate third sub-band signal having reduced wind noise, which is recombined with the respective sub-bands above the threshold $N_B$ to produce output first and second side signals.

20 Claims, 9 Drawing Sheets

(51) Int. Cl.

| | |
|---|---|
| ***H04R 5/04*** | (2006.01) |
| ***H04S 1/00*** | (2006.01) |
| ***H04R 3/00*** | (2006.01) |

(52) U.S. Cl.

CPC ..... *H04R 5/04* (2013.01); *H04S 1/002* (2013.01); *H04R 2410/05* (2013.01); *H04R 2410/07* (2013.01); *H04R 2499/11* (2013.01); *H04S 2400/09* (2013.01); *H04S 2400/15* (2013.01); *H04S 2420/07* (2013.01)

WIND NOISE REDUCTION

CROSS-REFERENCE TO RELATED APPLICATIONS

This application claims the benefit of Australian Provisional Patent Application No. 2013902592 filed 12 Jul. 2013, and Australian Provisional Patent Application No. 2014901430 filed 17 Apr. 2014, which are each incorporated herein by reference.

TECHNICAL FIELD

The present invention relates to the digital processing of signals from microphones or other such transducers, and in particular relates to a device and method for performing wind noise reduction in such signals.

BACKGROUND OF THE INVENTION

Processing signals from microphones in consumer electronic devices such as smartphones, hearing aids, headsets and the like presents a range of design problems. There are usually multiple microphones to consider, including one or more microphones on the body of the device and one or more external microphones such as headset or hands-free car kit microphones. In smartphones these microphones can be used not only to capture speech for phone calls, but also for recording voice notes. In the case of devices with a camera, one or more microphones may be used to enable recording of an audio track to accompany video captured by the camera. Increasingly, more than one microphone is being provided on the body of the device, for example to improve noise cancellation as is addressed in GB2484722 (Wolfson Microelectronics).

The device hardware associated with the microphones should provide for sufficient microphone inputs, preferably with individually adjustable gains, and flexible internal routing to cover all usage scenarios, which can be numerous in the case of a smartphone with an applications processor. Telephony functions should include a "side tone" so that the user can hear their own voice, and acoustic echo cancellation. Jack insertion detection should be provided to enable seamless switching between internal to external microphones when a headset or external microphone is plugged in or disconnected.

Wind noise detection and reduction is a particularly difficult problem in such devices. Wind noise is defined herein as a microphone signal generated from turbulence in an air stream flowing past microphone ports, as opposed to the sound of wind blowing past other objects such as the sound of rustling leaves as wind blows past a tree in the far field. Wind noise can be objectionable to the user and/or can mask other signals of interest. It is desirable that digital signal processing devices are configured to take steps to ameliorate the deleterious effects of wind noise upon signal quality.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of wind noise reduction, the method comprising:

deriving from a plurality of microphones at least one first side input signal and at least one second side input signal, the first and second sides each being one of a left side and a right side;

in a first stage:

splitting the first side signal into a first sub-band below a spectral threshold $N_A$ and a second sub-band above the spectral threshold $N_A$;

applying wind noise reduction to the first sub-band of the first signal to produce a wind noise reduced first sub-band of the first signal; and recombining the wind noise reduced first sub-band of the first signal with the second sub-band of the first signal, to produce a wind noise reduced first side signal;

in a second stage:

splitting the wind noise reduced first side signal into a third sub-band below a spectral threshold $N_B$ and a fourth sub-band above the spectral threshold $N_B$;

splitting the second side signal into a third sub-band below the spectral threshold $N_B$ and a fourth sub-band above the spectral threshold $N_B$;

mixing the third sub-band of the first side signal with the third sub-band of the second side signal to produce an aggregate third sub-band signal having reduced wind noise;

combining the aggregate third sub-band signal with the fourth sub-band of the first side signal to produce an output first side signal; and combining the aggregate third sub-band signal with the fourth sub-band of the second side signal to produce an output second side signal, and wherein $N_B$ is less than $N_A$.

The signal for the second side may itself be a wind noise reduced second side signal produced as part of the first stage, for example being produced in a corresponding manner as that in which the wind noise reduced first side signal is produced.

Preferably, when changes are required to the mixing of the third sub-band of the first side signal with the third sub-band of the second side signal, a smoothing of such changes is applied to avoid audible artefacts resulting from overly sudden changes in the mixing ratio.

In the first stage, wind noise reduction may be effected in the first side signal by:

receiving a secondary first side signal derived from one or more microphones positioned on the first side of the stereo environment;

splitting the secondary first side signal into a first sub-band below the spectral threshold $N_A$ and a second sub-band above the spectral threshold $N_A$;

mixing the first sub-band of the first side signal with the first sub-band of the secondary first side signal to produce an aggregate first sub-band signal having reduced wind noise; and combining the aggregate first sub-band signal with the second sub-band of the first side signal to produce the wind-noise-reduced first side signal.

Additionally or alternatively, a corresponding process may be applied to effect wind noise reduction in the second side signal in the first stage by receiving a secondary second side signal derived from one or more microphones positioned on the second side of the stereo environment.

In the first stage and second stage the wind noise reduction processing is preferably applied only to a spectral portion of the respective signal which is below a respective predefined threshold, with a remaining portion of the signal being unchanged by the wind-noise-reduction processing. Preferably, the sub-band threshold(s) applied in the first stage are selected to be large enough to work upon a substantial portion of the spectrum generated by wind noise. In some embodiments, $N_A$ is in the range of 300 Hz-10 kHz, more preferably 1 kHz-8 kHz, and for example may be substantially 3 kHz, or 8 kHz. Preferably, the sub-band threshold applied in the second stage is selected to be large enough to work upon a substantial portion of the spectrum generated by wind noise while being low enough to avoid, or minimise, negative effects on spatial cues carried in the left side and right side signals. In some embodiments, $N_B$ is in the range of 100 Hz-4 kHz, more preferably 300 Hz-3 kHz, and for example may be substantially 2 kHz, or 3 kHz.

In the first stage, wind noise reduction may be effected by taking a weighted sum of the two signals arising from the first side of the stereo environment, wherein the weighting is determined in a manner that the signal having least signal power is weighted more heavily. Such embodiments recognize that, for microphones which are equidistant from an audio source and at the same angle off-centre in the stereo environment, the microphone signal with most power is likely to be the microphone worst affected by wind noise.

Preferably, when changes are required to the mixing of the first sub-band of the first side signal with the first sub-band of the secondary first side signal, a smoothing of such changes is applied to avoid audible artefacts resulting from overly sudden changes in the mixing ratio.

According to a second aspect the present invention provides a device for wind noise reduction, the device comprising:

at least one first side microphone for generating a first side input signal;

at least one second side microphone for generating a second side input signal, the first and second sides each being one of a left side and a right side;

a first stage of signal processing circuitry comprising:

a band selector for splitting the first side signal into a first sub-band below a spectral threshold $N_A$ and a second sub-band above the spectral threshold $N_A$;

wind noise reduction circuitry for processing the first sub-band of the first signal to produce a wind noise reduced first sub-band of the first signal; and a sub-band combiner for recombining the wind noise reduced first sub-band of the first signal with the second sub-band of the first signal, to produce a wind noise reduced first side signal;

a second stage of signal processing circuitry comprising:

a band selector for splitting the wind noise reduced first side signal into a third sub-band below a spectral threshold $N_B$ and a fourth sub-band above the spectral threshold $N_B$;

a band selector for splitting the second side signal into a third sub-band below the spectral threshold $N_B$ and a fourth sub-band above the spectral threshold $N_B$;

a mixer for mixing the third sub-band of the first side signal with the third sub-band of the second side signal to produce an aggregate third sub-band signal having reduced wind noise;

a sub-band combiner for combining the aggregate third sub-band signal with the fourth sub-band of the first side signal to produce an output first side signal; and a sub-band combiner for combining the aggregate third sub-band signal with the fourth sub-band of the second side signal to produce an output second side signal, and wherein $N_B$ is less than $N_A$.

According to a further aspect the present invention provides a computing device configured to carry out the method of the first aspect.

According to another aspect the present invention provides a computer program product comprising computer program code means to make a computer execute a procedure for wind noise reduction in a signal, the computer program product comprising computer program code means for carrying out the method of the first aspect.

The wind noise reduction technique of the above embodiments may be selectively disabled when it is determined that little or no wind noise is present. Wind noise detection for this purpose may be effected by any suitable technique, and for example may be performed in accordance with the teachings of International Patent Application No. PCT/AU2012/001596 by the present applicant, the content of which is incorporated herein by reference. Wind noise reduction can be temporarily disabled in this manner by, for example, setting $N_A=N_B=0$. Preferably, wind noise reduction is gradually disabled, or gradually enabled, to avoid artefacts which may result from a step-change in wind noise reduction processing.

Some embodiments of the invention may operate upon four input signals derived from four microphones, to produce two stereo output signals. However, alternative embodiments of the invention may operate upon a lesser or greater number of input signals, and/or may produce a lesser or greater number of output signals.

The sub-band analysis may in some embodiments of the invention comprise a frequency sub-band analysis, or in other embodiments may comprise an alternative suitable sub-band analysis.

BRIEF DESCRIPTION OF THE DRAWINGS

An example of the invention will now be described with reference to the accompanying drawings, in which.

DESCRIPTION OF THE PREFERRED EMBODIMENTS

Figure 1A:
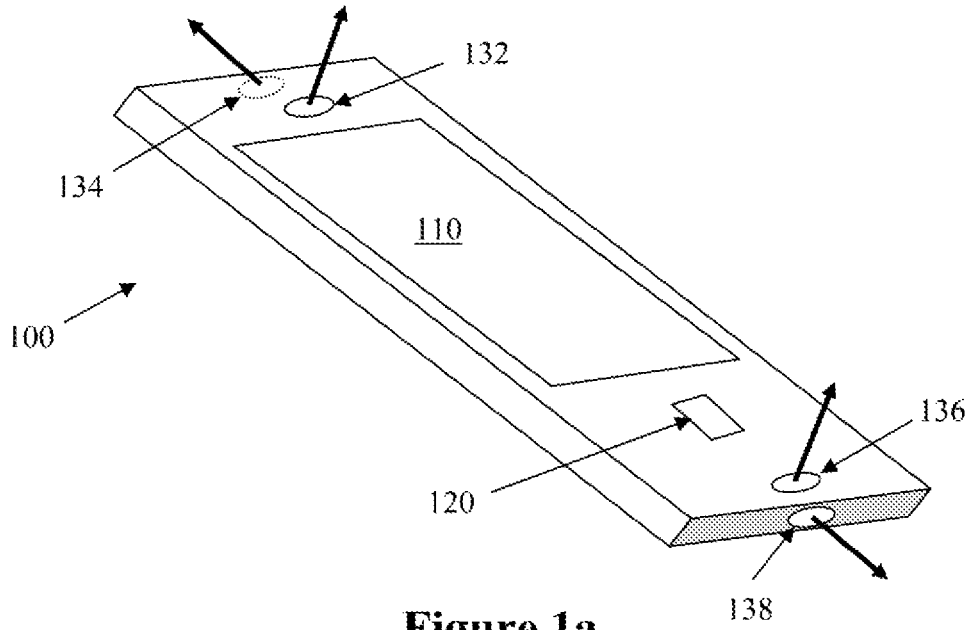
FIGS. 1*a* and 1*b* illustrate the layout of microphones of respective handheld devices in accordance with two embodiments of the invention.

FIG. 1*a* illustrates a handheld device 100 with touch-screen 110, button 120 and microphones 132, 134, 136, 138. The following embodiments describe the capture of stereo audio using such a device, for example to accompany a video recorded by a camera (not shown) of the device. Microphone 132 captures a first (primary) left signal $L_2$, microphone 134 captures a second (secondary) left signal $L_1$, microphone 136 captures a first (primary) right signal $R_1$, and microphone 138 captures a second (secondary) right signal $R_2$. As indicated, microphones 132 and 136 are both mounted in ports on a front face of the device 100. Thus, while all microphones of device 100 are omnidirectional, the port configuration gives microphones 132 and 136 a nominal direction of sensitivity indicated by the respective arrow, each being at a normal to a plane of the front face of the device. In contrast, microphones 134 and 138 are mounted in ports on opposed end surfaces of the device 100. Thus the nominal direction of sensitivity of microphone 134 is anti-parallel to that of microphone 138, and perpendicular to that of microphones 132 and 136. The following embodiments describe the capture of stereo audio using such a device, for example to accompany a video recorded by a camera (not shown) of the device.

Figure 1B:
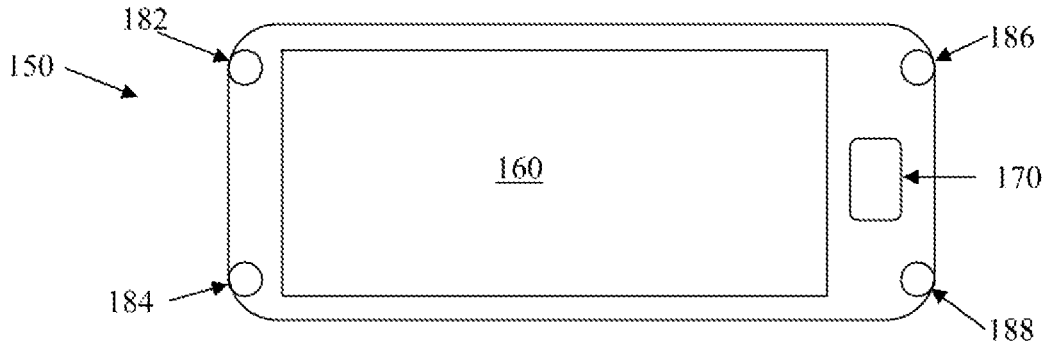

FIG. 1*b* illustrates a handheld device 150 of an alternative embodiment of the invention, with touchscreen 160, button 170 and microphones 182, 184, 186, 188. Microphone 182 captures a first (primary) left signal $L_2$, microphone 184 captures a second (secondary) left signal $L_1$, microphone 186 captures a first (primary) right signal $R_1$, and microphone 188 captures a second (secondary) right signal $R_2$. While the present invention may be applied in relation to the device 150 of FIG. 1*b*, the following wind noise reduction technique and apparatus has been found to have improved performance in relation to orthogonally placed microphones such as those in FIG. 1*a*.

Figure 3:
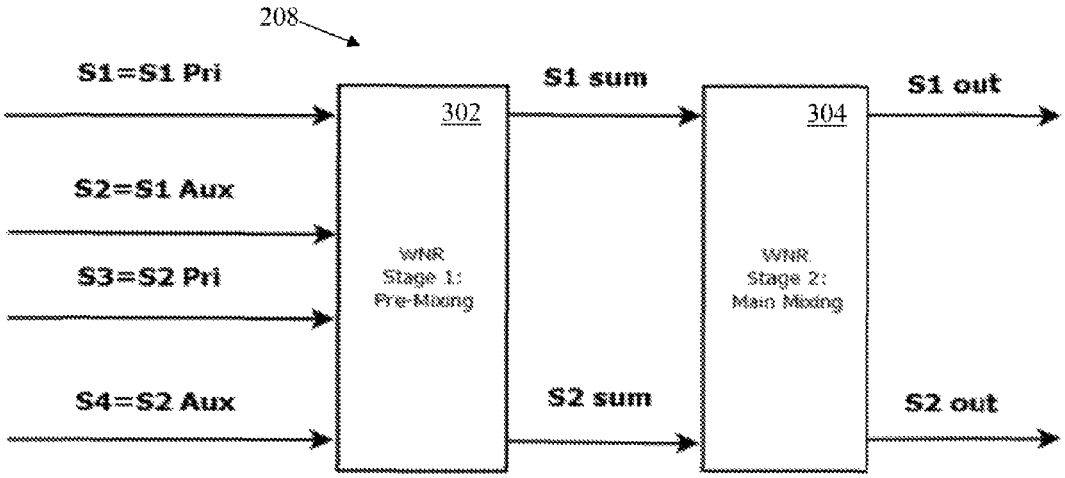
FIG. 3 illustrates the wind noise reduction block of the embodiment of FIG. 2.

It is important that the algorithm and parameters of the wind noise reduction module shown in FIG. 3 are optimised based on knowledge of where the microphones are positioned on the device 100, or 150. The performance of the wind noise reduction process is closely dependent on the microphone positions and relative spacing. Consequently, for a device having an alternative microphone layout to the device 100 or 150, consequential changes to the algorithm and parameters of the wind noise reduction module shown in FIG. 3 are likely to be required as will be understood by the skilled addressee.

Figure 2:
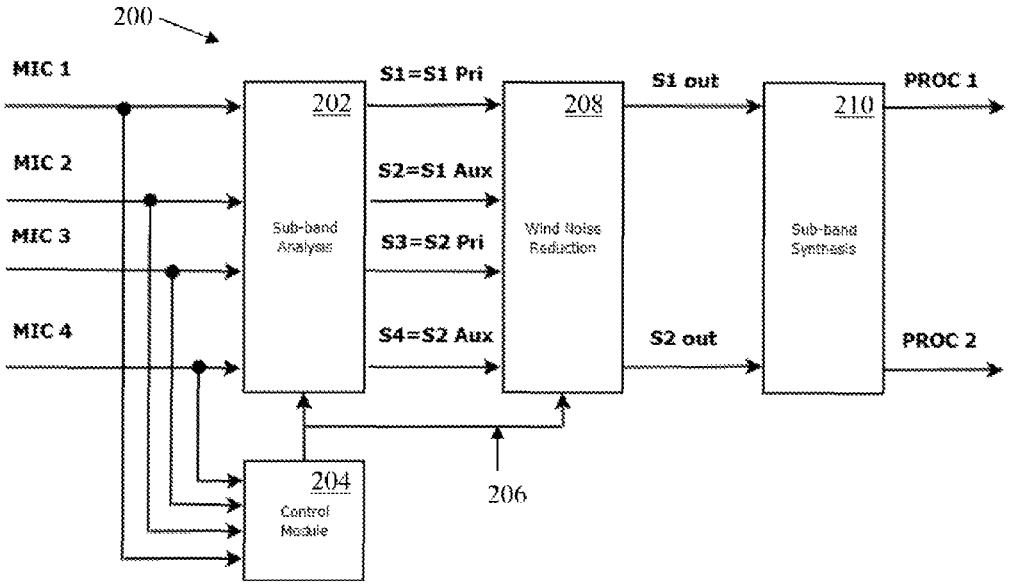
FIG. 2 is a block diagram of a system for wind noise reduction.

FIG. 2 is a block diagram of a system 200 which provides wind noise reduction in accordance with one embodiment of the present invention. The system 200 uses input signals MIC1, MIC2, MIC3 and MIC4 from the four microphones 132, 134, 136, 138, and produces two output signals PROC 1 and PROC2 (stereo).

In the system 200, the sub-band analysis block 202 operates to obtain a sub-band representation of each input signal. In this embodiment a frequency analysis is carried out by buffering samples from each input channel (MIC1, MIC2, MIC3 and MIC4), windowing the samples with a window function W(n) (e.g. Hamming window) and transforming the windowed samples into the frequency domain with the Discrete Fourier Transform (DFT), to produce frequency domain representations S1, S2, S3, and S4.

The wind noise reduction system 200 is guided by the control module 204. One purpose of the control module 204 is to sub-divide the set of four microphones into two pairs, where each pair consists of a primary microphone and an auxiliary microphone. In this example, the system has two microphones 132, 134 on the left side, out of which one microphone is nominated as the primary left (S1 Pri), and the other is nominated as the auxiliary left (S1 Aux). Similarly, on the right side there are two microphones 136, 138 out of which one microphone is nominated as the primary right (S2 Pri) and the other is nominated as the auxiliary right (S2 Aux). In this embodiment, the frequency domain representations of the microphone signals S1 and S2 are nominated to form the first pair S1 Pri and S1 Aux respectively. Similarly, frequency domain representations of the microphone signals S3 and S4 form the second pair S2 Pri and S2 Aux respectively.

The control module 204 is also configured to enable or disable the wind noise reduction block 208. The control module 204 sets signal 206 to 'enable' or '1', if the control module 204 detects that wind is present. The control module 204 sets signal 206 to 'disable' or '0', if the control module 204 detects that no wind is present or that only a sub-threshold amount of wind is present. In this embodiment, the wind noise detection technique applied by control module 204 includes a $\chi^2$ criterion as set out in International Patent Application No. PCT/AU2012/001596 and also a total microphone signal power level threshold. The wind noise reduction block 208 operates only if the wind noise detector indicates that a sufficient level of wind noise has been detected to justify activation of WNR 208.

When enabled, the wind noise reduction block 208 uses frequency domain representations of the signals S1 Pri, S1 Aux, S2 Pri, and S2 Aux, in order to reduce wind-generated noise. In general, the wind noise reduction block 208 attempts to minimize energy in each selected sub-band by preferring (via a weighted mixing) either the Pri or Aux signal depending on which has the lowest power in that sub-band in the presence of wind noise.

If wind noise is not detected and the signal 206 is set to 'disable', then the wind noise reduction block 208 simply copies the primary channels S1 Pri and S2 Pri to the output channels S1 Out and S2 Out.

The sub-band synthesis block 210 transforms the sub-band signals S1 Out and S2 Out into their full band representations PROC 1 and PROC 2. In this embodiment, where the sub-band analysis is a frequency analysis, the sub-band synthesis is performed as follows. First, the complex—conjugate Hermitian spectra of the corresponding signals are constructed. Then, two respective Inverse DFTs (IDFT) are performed to transform the Hermitian spectra representing the left and right channels into the time domain. A windowed overlap-add approach is used to finalise the reconstruction. It is to be noted that a suitable pre- and/or post-processing may be applied prior and/or after the wind noise reduction block 208 in order to further enhance the quality of wind reduction, as discussed in the following in relation to the embodiment of FIG. 8.

FIG. 3 illustrates the wind noise reduction block 208 of the embodiment of FIG. 2 in greater detail. For this four-microphone system, the wind noise reduction block 208 consists of two blocks: a pre-mixing block 302 and a main mixing block 304. In both blocks 302 and 304 the wind noise is reduced by optimally combining (mixing) frequency bins of each corresponding signal over a specified number of sub-bands N1. This mixing attempts to minimize sub-band energy of the resulting signal by choosing (via a weighted mixing) a sub-band of the respective side's signal pair (e.g. S1 Pri and S1 Aux) that has a lower power level in the presence of wind noise. In the pre-mixing block 302 the two left channels, S1 Pri and S1 Aux, are combined into an aggregate left channel S1 Sum. Similarly, in the pre-mixing block 302 the two right channels, S2 Pri and S2 Aux, are combined into an aggregate right channel S2 Sum. Sub-bands which did not take part in the mixing process (i.e. from N1 onwards) are copied into the aggregate left and right channels without change: from S1 Pri to S1 Sum, and from S2 Pri to S2 Sum.

In the main mixing block 304, the aggregate left channel S1 Sum and the aggregate right channel S2 Sum are combined over a specified number of sub-bands N2 into the output left and right channels S1 Out and S2 Out respectively. Similarly as for what occurs in the pre-mixing block 302, sub-bands which did not take part in the mixing process (i.e. from N2 onwards) are copied into the output left and right channels without change: from S1 Sum to S1 Out, and from S2 Sum to S2 Out.

Figure 4:
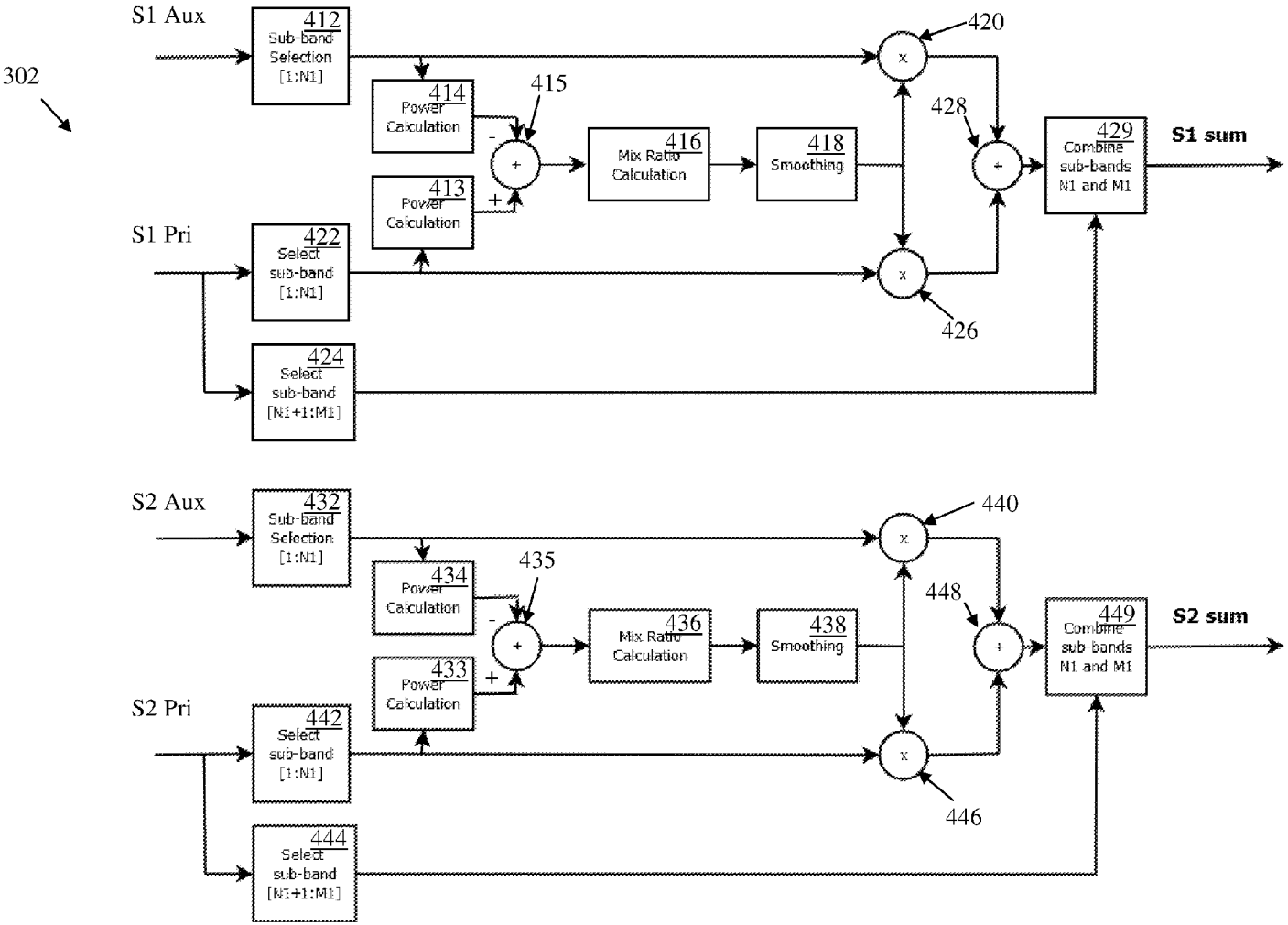
FIG. 4 is a detailed block-diagram of the pre-mixing block of FIG. 3.

FIG. 4 shows a detailed block-diagram of the pre-mixing block 302 for the four input/two output configuration of FIG. 3. In this processing stage, two left channels S1 Pri and S1 Aux are combined into an aggregate left channel S1 Sum, and two right channels S2 Pri and S2 Aux into an aggregate right channel S2 Sum, as follows.

When the presence of wind noise is detected by control module 204, low frequency sub-bands 1:N1 which span a band of $B_1$ kHz, [DC B1] kHz, are selected for mixing at 412, 422, 432, 442. The remaining N1+1:M1 high frequency sub-bands of the primary inputs S1 Pri and S2 Pri which span a frequency range $B_{1Res}$ kHz [$B_1$ $B_{total}$] kHz, are extracted at 424 and 444 and preserved. In this embodiment $B_1$=3 kHz and $B_{total}$=24 kHz.

For every sub-band within 1:N1, power levels P1 Pri and P1 Aux of the primary and auxiliary inputs S1 Pri and S1 Aux are calculated for the left channels, at 413 and 414, respectively. Similarly, for every sub-band within 1:N1, power levels P2 Pri and P2 Aux of the primary and auxiliary inputs S2 Pri and S2 Aux are calculated for the right channels, at 433 and 434, respectively. These are used to determine power level differences, ΔP1=P1 Pri−P1 Aux, for every sub-band 1:N1 of the left channel, at 415. Similarly power level differences ΔP2 =P2 Pri−P2 Aux for every sub-band 1:N1 of the right channel, are calculated at 435.

Figure 5:
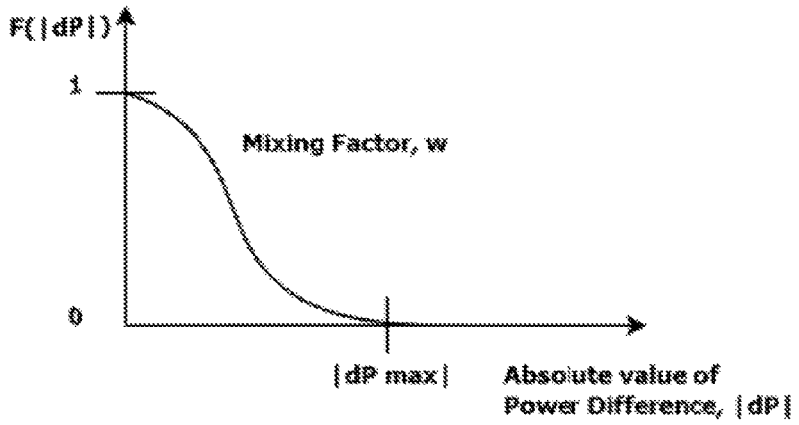
FIG. 5 illustrates a sigmoid mixing function.

The absolute value of the power level differences |ΔP1| and |ΔP2| are turned into corresponding mixing factors ω1 and ω2 using a mapping function $f(\cdot)$ in blocks 416, 436, respectively, shown in FIG. 5. The mapping function in this embodiment is a sigmoid function, whereby a larger |ΔP1| (or |ΔP2|) leads to a smaller mixing factor ω1 (or ω2), and the mixing factor is 0 if |ΔP1| (or |ΔP2|) is larger than |ΔP max|. On the other hand, the mixing factor is set to 1 if |ΔP1| (or |ΔP2|) are zero. Thus, the mapping rule is that larger absolute values of power level difference |ΔP1| and |ΔP2| lead to a smaller mixing factor. Mixing factors are smoothed by blocks 418 and 438, respectively, using a leaky integrator with a smoothing tap aα.

In turn, mixing is performed for each sub-band out of the specified band [1: N1], as shown at 420, 426, 428, for the left channel. This effects the following:

If ΔP1≥0

$$S1\ Sum=\omega 1\cdot S1\ Pri+(1-\omega 1)\cdot S1\ Aux$$

Else $$S1\ Sum=\omega 1\cdot S1\ Aux+(1-\omega 1)\cdot S1\ Pri$$

The effect of this process is that for positive power level differences, the smaller mixing factors ω1 (larger ΔP1 or, equivalently, P1 Pri>P1 Aux) stipulate that a larger portion of the signal which has less energy is passed to the output S1 Sum. Note, that when ω1=0 (or ΔP1>ΔP max) the output signal S1 Sum is fully represented by the signal S1 Aux, which means full substitution or 'no mixing'; and when ω1=1 (or ΔP1=0) the output signal S1 Sum is fully represented by the signal S1 Pri, which also means 'no mixing'. In all other cases, 0<ω1<1, the mixing is performed as shown above. On the other hand, for negative power level differences, the smaller mixing factors ω1 (P1 Pri<P1 Aux) again work to stipulate that a larger portion of the signal which has less energy is passed to the output S1 Sum. When ω1=0 (or ΔP1<−ΔP max) the output signal S1 Sum is fully represented by the signal S1 Pri, which means full substitution or 'no mixing'. In all other cases, 0<ω1<1 the mixing is performed as shown above.

The corresponding mixing is performed for the right channel, for each sub-band out of the specified band [1:N1], as shown at 440, 446, 448.

The final stage 429 of pre-mixing block 302 serves to reconstruct the total spectra of S1 Sum, by combining the low frequency portions ([DC B1] kHz), for which mixing was performed, with the preserved band B1Res of the primary signals S1 Pri and S2 pri. Thus block 429 produces S1 Sum=[S1 Sum S1 Pri(N1+1:M1)]. Similarly, block 449 produces S2 Sum=[S2 Sum S2 Pri(N1+1:M1)].

As noted in the preceding, at times when the control module 204 determines that no wind noise is present, the wind noise reduction module 208 is disabled. However to avoid a step-change in processing and possible associated signal artefacts, the enabling or disabling of the wind noise reduction module 208 is performed gradually. This is achieved in block 302 by gradually releasing the mixing factors ω1 and ω2 in each sub-band to 1, as follows:

$$\omega 1=a+(1-a)\cdot\omega 1$$

$$\omega 2=a+(1-a)\cdot\omega 2$$

In this way the mixing factors in each band are gradually released to 1, being a state of no mixing.

Figure 6:
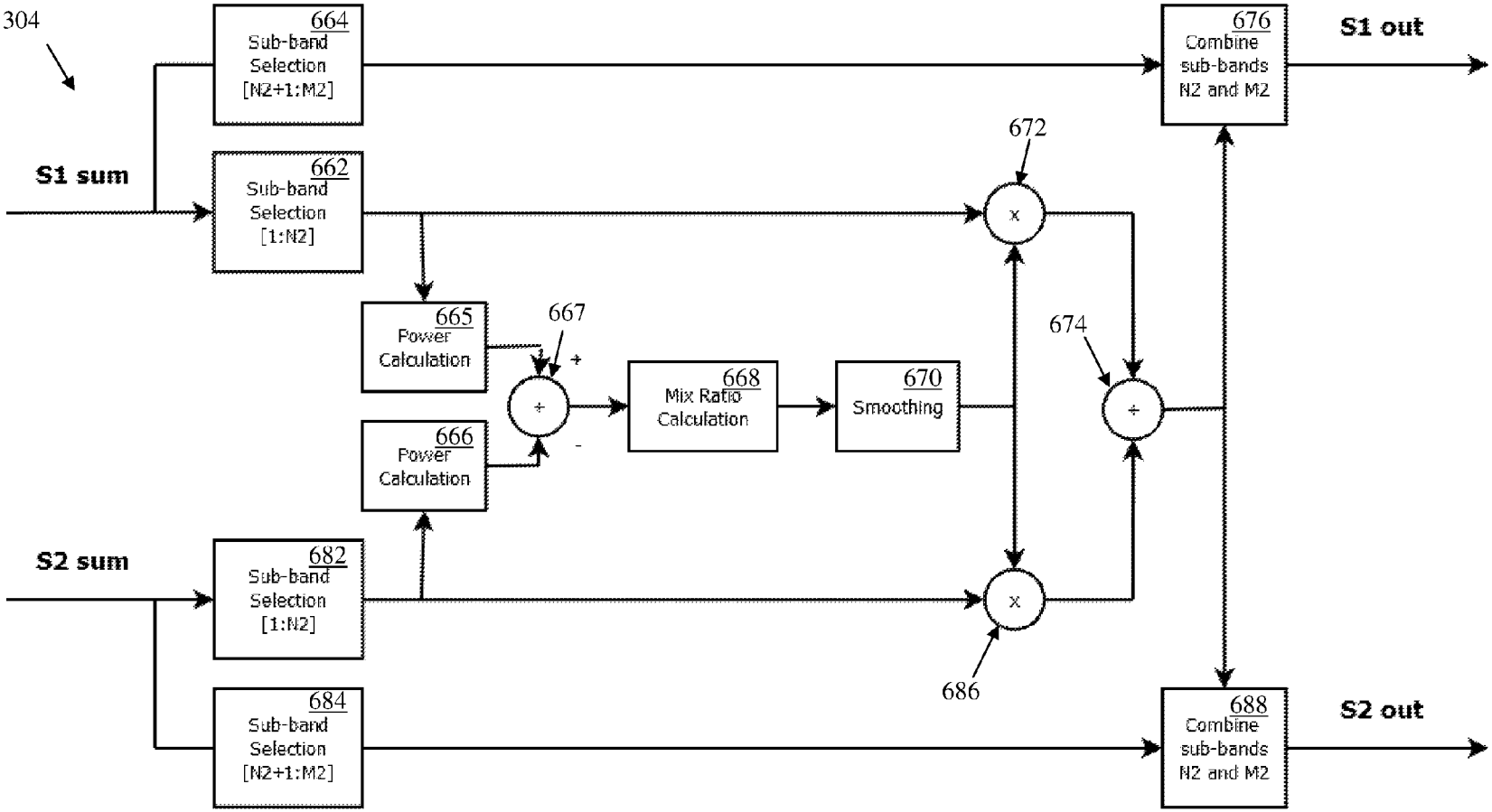
FIG. 6 depicts a detailed block-diagram of the main mixing block in the embodiment of FIG. 3.

FIG. 6 depicts a detailed block-diagram of the main mixing block 304 in the embodiment of FIG. 3. In this stage, the aggregate left and right channels S1 Sum and S2 Sum produced by block 302 of FIG. 4 are combined, in order to produce output left and right channels S1 Out and S2 Out respectively, as follows. When the presence of wind noise is detected and wind noise reduction is enabled, low frequency sub-bands 1:N2 which span a band of B2 kHz, [DC B2] kHz, are selected at 662 and 682 for mixing. The remaining high frequency N2+1:M2 sub-bands of the aggregate signals S1 Sum and S2 Sum which span a frequency range B2Res kHz [B2 Btotal] kHz, are preserved at 664, 84.

For each sub-band in 1:N2, the power levels P1 Sum, P2 Sum of the aggregate left and right signals are calculated at 665 and 666, and then the power level difference, ΔP Sum=P1 Sum−P2 Sum, is calculated at 667.

The absolute value of the power level difference |ΔP Sum| is turned into a corresponding mixing factor ω at 668 using a sigmoid mapping function $f(\cdot)$ (as for FIG. 5). Once again, a larger |ΔP Sum| leads to smaller mixing factor ω; and the mixing factor becomes 0 if |ΔP Sum| is larger than |ΔP max|. On the other hand, mixing factors turn to 1 if |ΔP Sum| is zero. So, the mapping rule is that larger absolute value of power level difference |ΔP Sum| leads to a smaller mixing factor. It is to be appreciated that the parameters of the mapping function $f(\cdot)$, including the value of ΔP max, for the pre-mixing block 302 may be different compared to those for the main mixing block 304. The mixing factor is then smoothed at 670 using a leaky integrator with a smoothing tap α.

Mixing is performed at 672, 686 and 674 for each sub-band within [1:N2], as follows.

If ΔP Sum≥0

$S1\ Out=\omega\cdot S1\ Sum+(1-\omega)\cdot S2\ Sum$

S2 Out=S1 Out

Else $S1\ Out=\omega\cdot S2\ Sum+(1-\omega)\cdot S1\ Sum$

S2 Out=S1 Out

This process has the effect that for a positive power level difference, smaller mixing factors ω (larger ΔP Sum or, equivalently, P1 Sum>P2 Sum) stipulate that a larger portion of the signal having less energy in the presence of wind noise is passed to the output S1 Out. Note, that when ω=0 (or ΔP Sum>ΔP max) the output signal S1 Out is fully represented by the signal S2 Sum, which means full substitution or 'no mixing'; and when ω=1 (or ΔP Sum=0) the output signal S1 Out is fully represented by the signal S1 Sum, which also means 'no mixing'. In all other cases, 0<ω<1 the mixing is performed as shown above. On the other hand, for negative power level differences, a smaller mixing factor ω(P1 Sum<P2 Sum) stipulates that a larger portion of the signal having less energy in the presence of wind noise is passed to the output S1 Out. When ω=0 (or ΔP Sum<−ΔP max) the output signal S1 Out is fully represented by the signal S1 Sum, which means full substitution or 'no mixing'. In all other cases, 0<ω<1 the mixing is performed as shown above.

The total spectra of the S1 Out and S2 Out signals are reconstructed at 676 and 688 by combining the portions for which mixing was performed ([DC B2] kHz) with the band B1Res of the aggregate signals S1 Sum and S2 Sum preserved by 664 and 684. Thus, S1 Out=[S1 Out S1 Sum(N2+1:M2)] and S2 Out=[S2 Out S2 Sum(N2+1:M2)].

As noted in the preceding, at times when the control module 204 determines that no wind noise is present, the wind noise reduction module 208 is disabled. However to avoid a step-change in processing and possible associated signal artefacts, the enabling or disabling of the wind noise reduction module 208 is performed gradually. This is achieved in block 304 by gradually releasing the mixing factors ω1 and ω2 in each sub-band to 1, as follows:

$$\omega 1=a+(1-a)\cdot\omega 1$$

$$\omega 2=a+(1-a)\cdot\omega 2$$

In this way the mixing factors in each band are gradually released to 1, being a state of no mixing.

Figure 7:
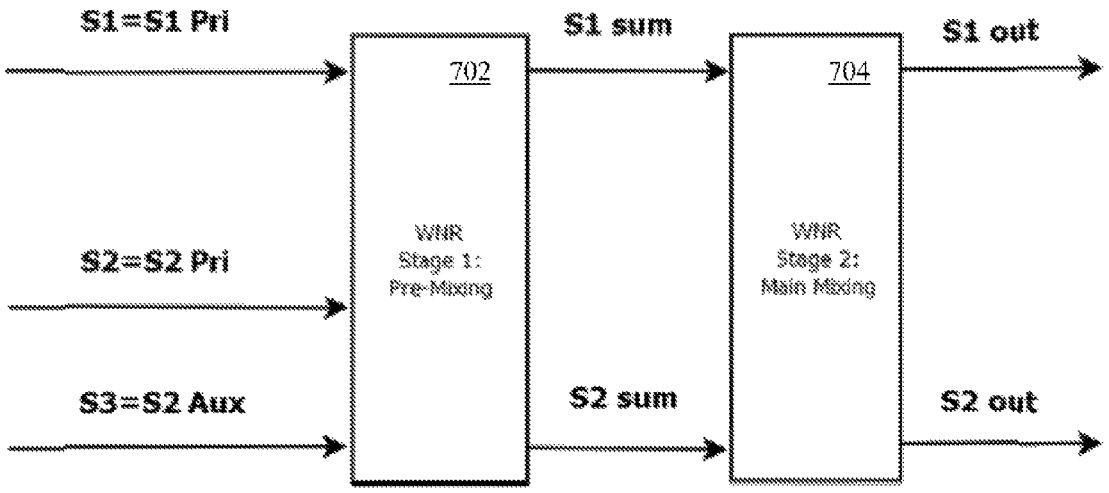
FIG. 7 illustrates a wind noise reduction module in accordance with an alternative embodiment of the invention.

FIG. 7 illustrates a wind noise reduction block in accordance with an alternative embodiment of the invention, for a case of 3 microphones and 2 processed audio outputs. For this three-microphone system, it also consists of two blocks: Pre-Mixing Block 702 and Main Mixing Block 704. In both blocks the wind noise is reduced by optimally combining (mixing) frequency bins of each corresponding signal: mixing attempts to minimize sub-band energy of the resulting signal by choosing (weighted mixing) a sub-band of the signal (e.g. S2 Pri and S2 Aux) that has a lower power level subject to the wind noise presence. In the Pre-Mixing block 702 the left channels, S1 Pri is copied into an aggregate left channel S1 Sum, as is. The two right channels, S2 Pri and S2 Aux, are combined into an aggregate right channel S2 Sum. Sub-bands which did not take part in the mixing process are copied into the aggregate right channels as is: from S2 Pri to S2 Sum. In the main mixing block 704, the aggregate left channel S1 Sum and the aggregate right channel S2 Sum are combined into the output left and right channels S1 Out and S2 Out respectively. Similarly, sub-bands which did not take part in the mixing process are copied into the output left and right channels as is: from S1 Sum to S1 Out, and from S2 Sum to S2 Out.

It is to be noted that, in embodiments similar to that shown in FIGS. 3 and 7, if the number of input microphones is reduced to two and the number of processed audio outputs is kept at 2 (stereo), the Pre-Mixing Block 302 or 702 is instead a 'pass through', where both inputs are copied to the output of said Pre-Mixing block as is; and the Main Mixing Block would not be affected. That is, a change in the number of microphones changes the processing in the Pre-Mixing Block. If on the other hand, the number of processed audio outputs is reduced to one (mono), then the processing of the Pre-Mixing Block 302 or 702 will remain unchanged, but the Main Mixing Block would be modified so that the aggregate left channel S1 Sum and the aggregate right channel S2 Sum are combined into the single output channel S Out by weighted mixing over the entire frequency range. That is, a change in the number of processed audio outputs changes the processing in the Main Mixing Block 304 or 704.

Figure 8:
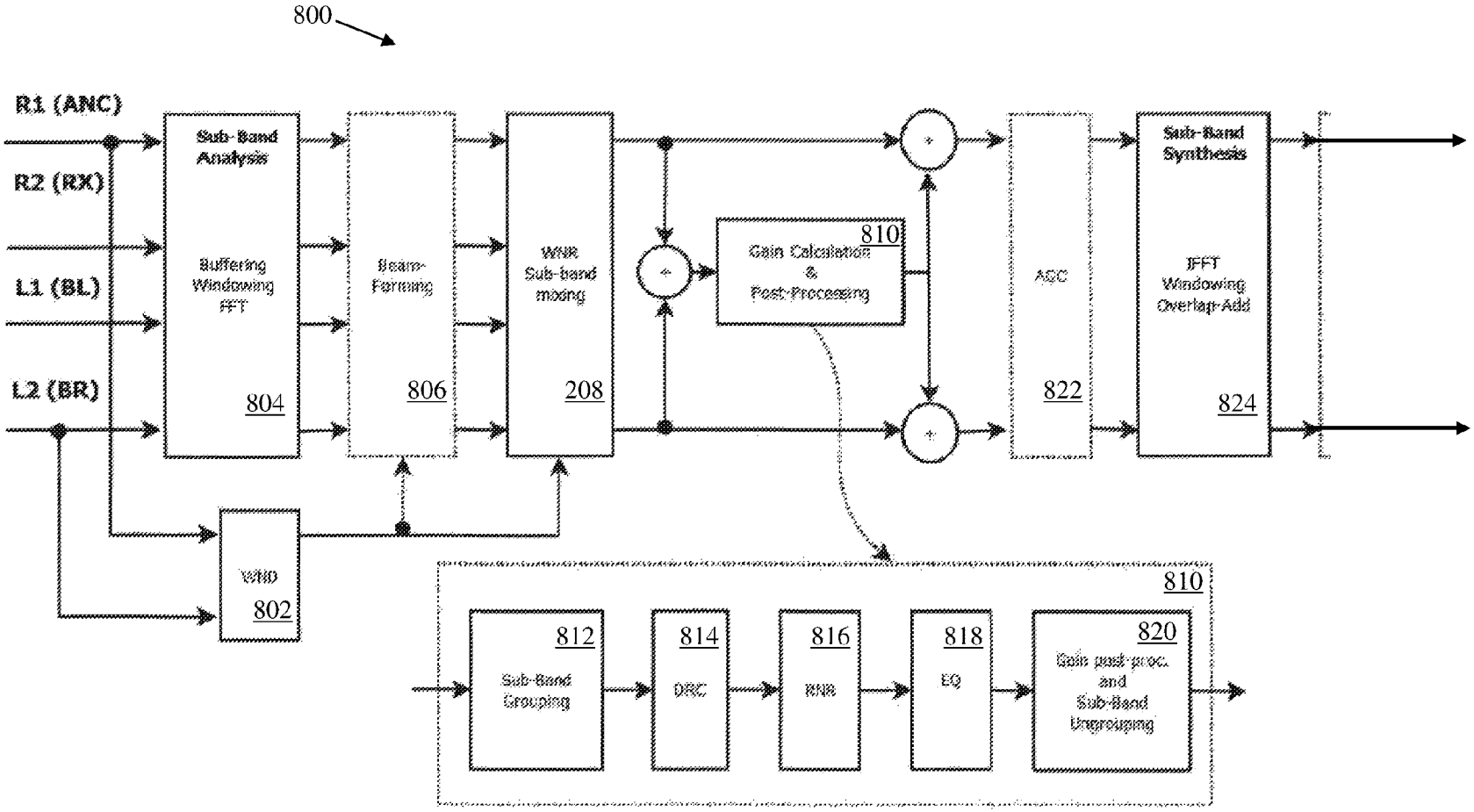
FIG. 8 illustrates a DSP system for wind noise reduction in accordance with a further embodiment of the invention.

FIG. 8 illustrates a digital signal processing (DSP) system 800 within which the above described embodiments of the invention may for example be implemented. The DSP system 800 is provided within the device 100, for capturing stereo audio from the plurality of microphones of the device 100. The DSP system 800 has four inputs: two left side inputs $L_1$ and $L_2$ from microphones 132 and 134, and two right side inputs $R_1$ and $R_2$ from microphones 136 and 138. Inputs $L_2$ and $R_1$ are designated as the primary inputs in this embodiment. The DSP system 800 undertakes a range of signal processing in order to produce a stereo output comprising a left output signal L and a right output signal R. The stereo output signals L and R may then be saved to disk as the audio track for the captured video, or used for any other suitable purpose.

In more detail, the DSP system of FIG. 8 comprises a WND block 802, which is a full band wind noise detector. A sub-band analysis DSP block 804 of the DSP system 800 is used to obtain a frequency domain representation of the input signals as described above with reference to FIG. 2.

Wind noise reduction DSP block 208 of the DSP system 800 reduces wind noise using sub-band mixing as described previously herein.

Gain calculation and post-processing is also provided, as shown at 810. A single gain is calculated and applied to both left (L) and right (R) channels; for this purpose, dB levels of the left and right channels are summed (on bin-by-bin basis) prior to the gain calculations.

Sub-band grouping is implemented at 812 in order to reduce audio artefacts and save processor cycles. A dynamic range converter 814 is used to match the dynamic behaviour of the input signal to certain requirements.

The system of FIG. 8 further comprises residual noise reduction 816 and an equaliser EQ 818 which applies a fixed or externally defined gain on a 'per sub-band' basis by adding dB values to the current gains.

The system of FIG. 8 further comprises a block 820 for sub-band ungrouping, post-processing, and group transition smoothing, an AGC 822 block for automatic gain control, and sub-band synthesis block 824 as previously described herein.

The above-described embodiments are directed to a suite of algorithms optimised to improve the quality of stereo audio being captured as a part of a video recording by a handheld device with multiple on-board microphones. However it is to be appreciated that the wind noise reduction techniques described herein may be adapted for use in other applications in which audio is captured by multiple microphones.

In alternative embodiments, the mixing thresholds $N_1$ and $N_2$, or $N_{L1}$, $N_{R1}$ and $N_{L2}$ and $N_{R2}$, can be dynamically controlled to permit dynamic mixing and wind noise reduction. For example, setting each threshold to zero is a manner in which wind noise reduction can be switched off, for example if the wind noise detector 802 indicates that no wind noise is present. Or in a more sophisticated arrangement, the respective threshold could be selected to take a non-zero value which is based on an estimate of the cut off frequency at which a detected amount of wind noise falls to a level close to the ambient background noise level. In this way the mixing is not applied unnecessarily in those frequency bands in which the wind noise is masked by the background noise in bands above the variable threshold. For example, in a situation where low velocity wind is masked by the environmental noise in all frequencies above say 500 Hz, a cut-off frequency (mixing threshold N) of 500 Hz may be selected and may be beneficial in better preserving binaural cues residing between 500 Hz and a higher default value for each threshold N (e.g. 3 kHz).

In video applications audio is typically captured in stereo and at sampling rates of 44.1 kHz or 48 kHz, in contrast to applications such as telephony in which the audio signal is typically mono and captured at an 8 kHZ sampling rate.

Figure 9:
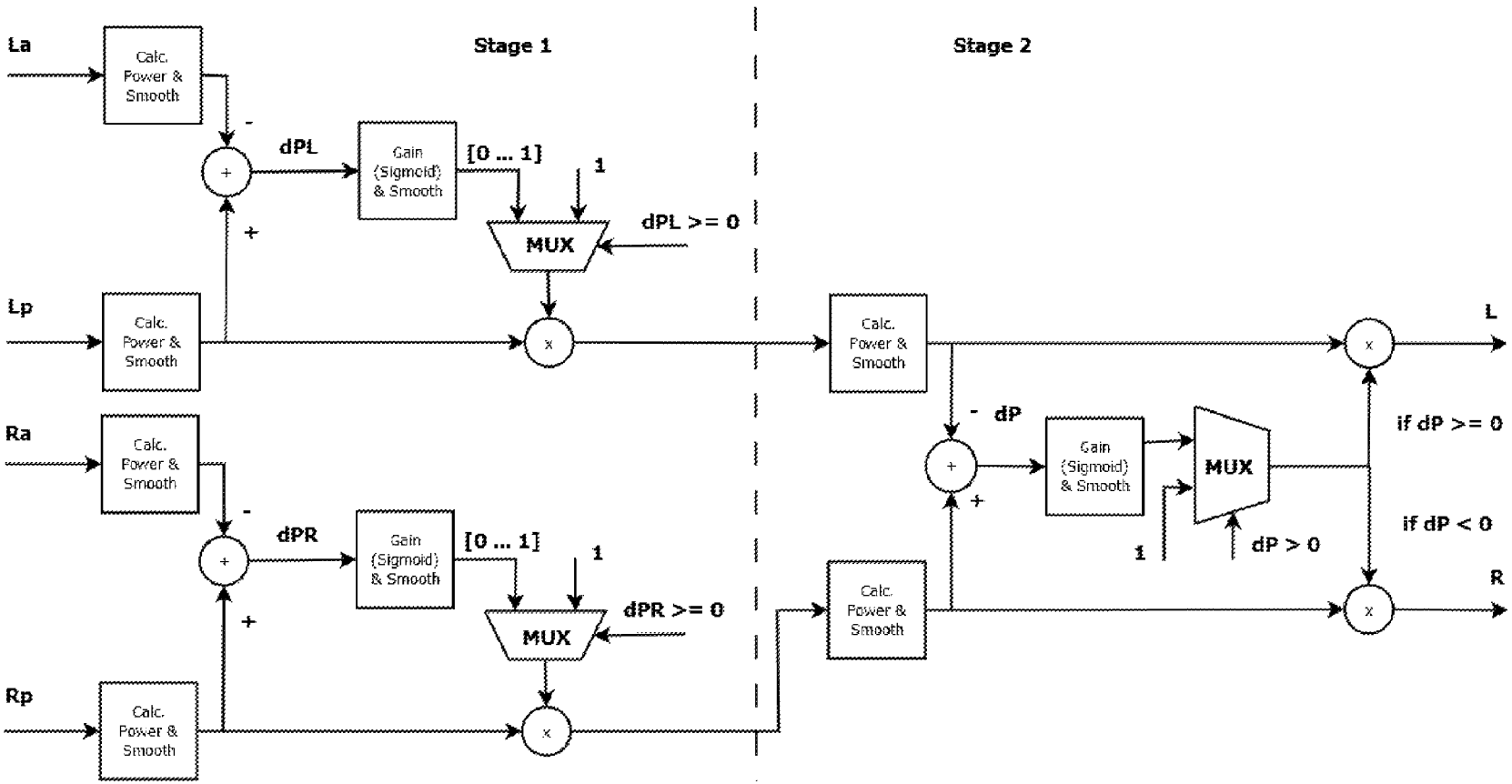
FIG. 9 is a generalized block diagram for a multi-microphone wind noise reduction system in accordance with another embodiment of the invention.

FIG. 9 is a generalised block diagram for a multi-microphone wind noise reduction system in accordance with another embodiment of the invention. This embodiment gives an example where the phases of the primary (Lp & Rp) signals are not mixed, but instead are preserved.

Once again, in this embodiment the wind noise reduction is only implemented if wind noise is present. If wind noise is detected, the wind noise reduction is performed as described below. Otherwise, the primary channels Lp (Left Primary) and Rp (Right Primary) are copied to the output channels L and R, by gradually releasing all gains to 1.

In general, the embodiment of FIG. 9 attempts to minimize sub-band energy by attenuating a sub-band which has the highest dB level. In Stage I two left channels, $L_p$ & $L_a$ (Left Primary and Left Auxiliary), are combined into an aggregate left channel and two right channels $R_p$ & $_a$ (Right Primary and Right Auxiliary), are combined into an aggregate right channel, in the following manner.

Sub-bands $1{:}N_1$ which span a band of $B_1$=8 kHz (DC to 8 kHz) are selected. The remaining $N_1{+}1{:}M_1$ sub-bands of the primary inputs $L_1$ and $R_1$ which span a frequency range $B_{1\ res}$=16 kHz (8 kHz to 24 kHz) remain unchanged. For each channel the corresponding powers (PLp, PLa, PRp, PRa) are calculated and smoothed, and dB power level differences, dP(L or R)=P(L or R)p−P(L or R)a, are calculated for every sub-band in 1:$N_1$, If the power level difference is positive (meaning that there is more wind noise in the primary channel), then the level difference dP(L or R) is turned into corresponding linear gain G(L or R)={Gmin,1} using a sigmoid function so that a larger positive difference leads to a smaller (closer to Gmin) Gain. The Gain is in a linear scale, not dB. The resulting left and right channel Gains are smoothed using a leaky integrator. Otherwise the gain G(L or R) is gradually released to 1.

The Gain thus determined is applied by multiplying the Left or Right Real and Imaginary signal components by a corresponding gain: Re(Lp)=GainL*Re(Lp), Im(Lp) =GainL*Im(Lp) and Re(Rp)=GainR*Re(Rp), Im(Rp) =GainR*Im(Rp).

In Stage 2 of FIG. 9, the outputs from the first stage are turned into overall output signals left (L) and right (R), as follows. Sub-bands 1:$N_2$ which span a band of $B_2$=5 kHz (DC to 5 kHz) are selected for mixing. The remaining $N_2{+}1{:}M_2$ sub-bands of the left and right channels, which span frequency range $B_{2\ res}$=19 kHz (5 kHz to 24 kHz), remain unchanged. For each channel the corresponding powers ($P_L$ and $P_R$) are calculated and smoothed, and the dB power level differences, $dP=P_L-P_R$, are calculated for every sub-band in $1{:}N_2$. Next the level difference dP is turned into a corresponding linear gain G={Gmin, 1} using a sigmoid so that a larger positive difference leads to a smaller (closer to Gmin) Gain. The resulting channel Gain is smoothed using a leaky integrator. If the power level difference is positive (dP>=0), then the gain is applied by multiplying the Left Real and Imaginary signal components by this gain: Re(L) =Gain*Re(L), Im(L)=Gain*Im(L) and the Right channel remains unchanged. Otherwise the gain is applied by multiplying the Right Real and Imaginary signal components (dP<0)−Re(R)=Gain*Re(R), Im(R)=Gain*Im(R), and the Left channel remains unchanged.

It is noted that the embodiment of FIG. 9 utilises a cutoff frequency in stage 1 of 8 kHz, and in stage 2 of 5 kHz. This is in contrast to the embodiment of FIG. 4 having cutoff $N_1$=3 kHz. The cutoff frequency is thus fully parameterisable so that any suitable value for each cutoff frequency may be chosen in alternative embodiments.

Figure 10:
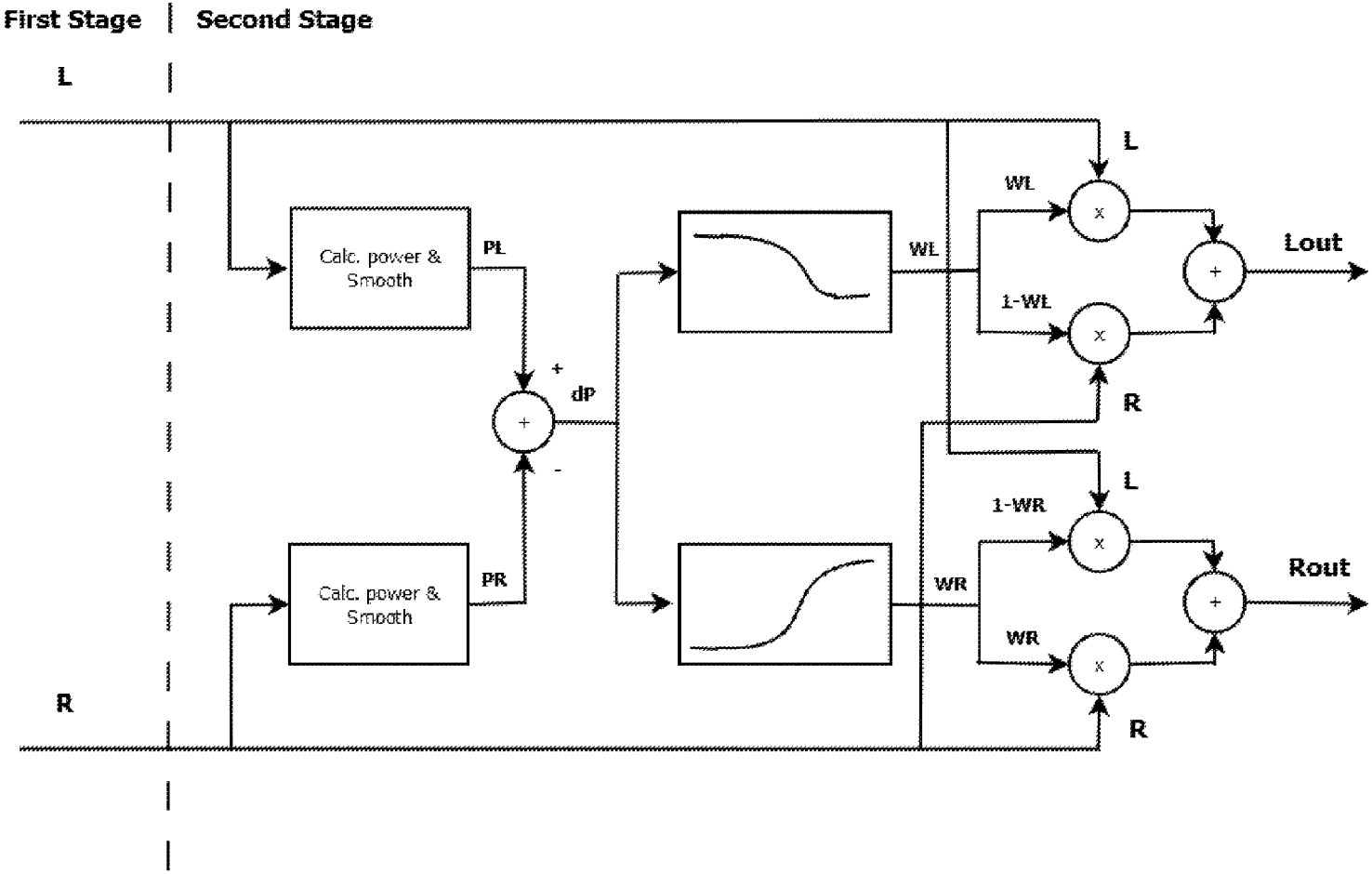
FIG. 10 is a generalized block diagram for a multi-microphone wind noise reduction system in accordance with still another embodiment of the invention.

FIG. 10 illustrates second stage mixing in accordance with yet another embodiment of the invention. The inputs to it may be the left and right outputs of the first stage mixing:

- L=first_stage_mix($L_p$,$L_a$) and R=first_stage_mix($R_p$,$R_a$) for a 4-microphone system; or
- L=first_stage_mix($L_p$,$L_a$) and R=$R_p$, or L=$L_p$ and R=first_stage_mix($R_p$,$R_a$) for a 3-microphone system; or
- L=$L_p$ and R=$R_p$ (no first stage mixing) for a 2-microphone system or otherwise.

The algorithm is presented with the sub-band representation of signal L and the signal R. In general, the algorithm compares the power, $P_L(i)$, of the i-th sub-band of the left channel with the power, $P_R(i)$, of the i-th sub-band of the right channel and attempts to preserve the sub-band which has a smaller power while maintaining a certain (controllable) amount of spatial cues between left and right output channels $L_{out}$ and $R_{out}$ The block diagram of the proposed algorithm is shown in FIG. 10. If wind is detected, the wind noise reduction is performed as described below. Otherwise, the primary channels $L_p$ (Left Primary) and $R_p$ (Right Primary) are copied to the output channels $L_{out}$ and $R_{out}$.

If wind is present, the embodiment of FIG. 10 operates as follows:

- Sub-bands 1:$N_2$ which span a band of $B_2$=X kHz (DC to X kHz) are selected for mixing; remaining $N_2{+}1{:}M_2$ sub-bands of the left and right channels which span frequency range $B_{2\ res}$=24-X kHz (X kHz to 24 kHz)

remain unchanged. Note that the second stage mixing may be done over all available sub-bands of the L&R channels (X=24 kHz).

Figure 11:
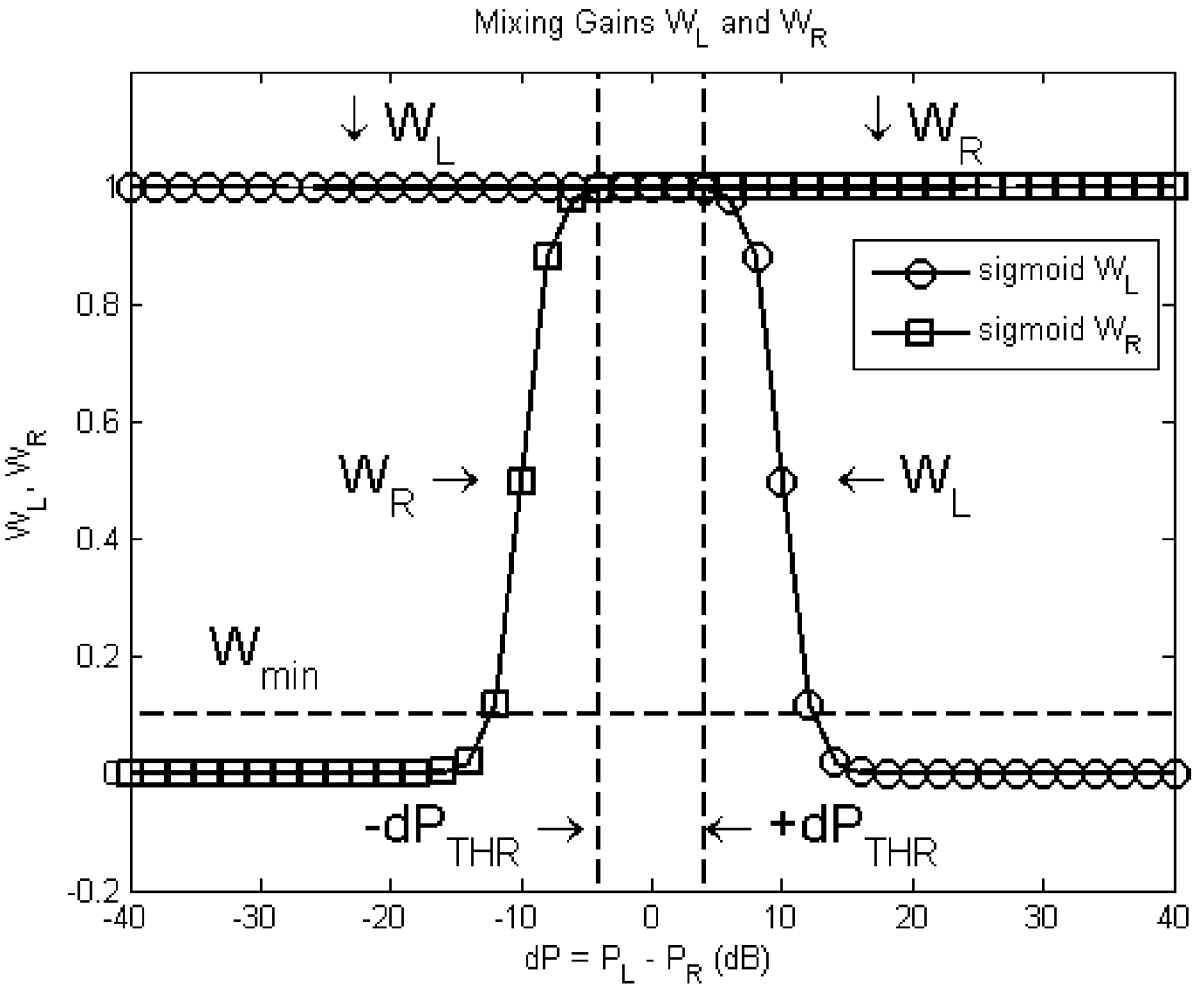
FIG. 11 illustrates the boundaries of the sigmoid mixing functions in the embodiment of FIG. 10.

For each channel (L&R) the corresponding powers $P_L$ and $P_R$ are calculated and smoothed Power difference (in dB), $dP=P_L-P_R$ is calculated for every sub-band in 1:$N_2$ The power level difference dB is mapped onto mixing gains $W_L$ and $W_R$ using sigmoid functions as follows.

$$W_{L,R}(dP) = \frac{1}{1+e^{KA+B}} \tag{1}$$

where K=1 for $W_L$, and K=−1 for $W_R$; A is a slope of sigmoid functions, and B is their bias Set the minimum fluxing gain $W_{min}$ which defines residual spatial cues between L&R. channels. Using sigmoid parameters A and B set the power level difference threshold $dP_{THR}$ which defines 'no mixing' and 'full mixing' boundaries of the sigmoid functions as shown in FIG. 11.

Calculate mixing gains $W_L(dP)$ and $W_R(dP)$ according to (1) (see FIG. 2)

Perform mixing as follows.

$$L_{out}=W_L \cdot L+(1-W_L)\cdot R$$

$$R_{out}=W_R \cdot R+(1-W_R)\cdot L \tag{2}$$

In one example of the embodiment of FIG. 10, Parameters: A=1, B=−10 (dB)=>$dP_{THR}$=4 (dB), $W_{min}$=0.1, K=1 for $W_L$ and K=−1 for $W_R$.

Power in the left channel is larger than the power in the right channel: $P_L>>P_R$ So that the power difference is positive and above the threshold: dP>0 and $dP>dP_{THR}$ Mixing gains (see (1) and FIG. 2): $W_L=W_{min}0.1$; $W_R=1.0$ Result:

$L_{out}$=0.1 *L*+0.9 *R*−fall to the lower power signal, some spatial cues still preserved $R_{out}$=R In one example of the embodiment of FIG. 10, with parameters as for the above example:

Power in the left channel is smaller than the power in the right channel: $P_L<<P_R$ So that the power difference is negative and dP<0 and $dP<-dP_{THR}$ Mixing gains (see (1) and FIG. 2): $W_L$=1.0; $W_R=W_{min}$=0.1

Result

Lout=L

Lout=0.1 *R*+0.9 *L*−fall to the lower power signal, some spatial cues still preserved.

If wind is not present, the embodiment of FIG. 10 gradually releases both gains to 1.0.

Note that instead of sub-band powers, the full-band (calculated over the entire band) powers $P_L$ and $P_R$ may be used for the mixing gain calculations. In this case, the same mixing gain $W_L$ (or $W_R$) is applied on to all the sub-bands during mixing process (2).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of wind noise reduction, the method comprising:

deriving from a plurality of microphones at least one first side input signal and at least one second side input signal, the first and second sides each being one of a left side and a right side;

in a first stage of signal processing circuitry:

splitting the first side input signal into a first sub-band below a spectral threshold $N_A$ and a second sub-band above the spectral threshold $N_A$;

applying wind noise reduction to the first sub-band of the first side input signal to produce a wind noise reduced first sub-band of the first side input signal; and recombining the wind noise reduced first sub-band of the first side input signal with the second sub-band of the first side input signal, to produce a wind noise reduced first side input signal;

in a second stage of signal processing circuitry:

splitting the wind noise reduced first side input signal into a third sub-band below a spectral threshold $N_B$ and a fourth sub-band above the spectral threshold $N_B$;

splitting the second side input signal into a third sub-band below the spectral threshold $N_B$ and a fourth sub-band above the spectral threshold $N_B$;

mixing the third sub-band of the first side input signal with the third sub-band of the second side input signal to produce an aggregate third sub-band signal having reduced wind noise;

combining the aggregate third sub-band signal with the fourth sub-band of the first side input signal to produce an output first side input signal; and combining the aggregate third sub-band signal with the fourth sub-band of the second side input signal to produce an output second side input signal, and wherein $N_B$ is less than $N_A$.

2. The method of claim 1 wherein the signal for the second side is a wind noise reduced second side signal produced as part of the first stage.

3. The method of claim 1 wherein, when changes are required to the mixing of the third sub-band of the first side input signal with the third sub-band of the second side input signal, a smoothing of such changes is applied to avoid audible artefacts.

4. The method of claim 1 wherein, in the first stage, wind noise reduction is effected in the first side input signal by:

receiving a secondary first side signal derived from one or more microphones positioned on the first side of the stereo environment;

splitting the secondary first side signal into a first sub-band below the spectral threshold $N_A$ and a second sub-band above the spectral threshold $N_A$;

mixing the first sub-band of the first side signal with the first sub-band of the secondary first side signal to produce an aggregate first sub-band signal having reduced wind noise; and combining the aggregate first sub-band signal with the second sub-band of the first side input signal to produce the wind-noise-reduced first side signal.

5. The method of claim 1 wherein wind noise reduction is effected in the second side input signal in the first stage by receiving a secondary second side signal derived from one or more microphones positioned on the second side of the stereo environment.

6. The method of claim 1 wherein in the first stage and second stage the wind noise reduction processing is applied only to a spectral portion of the respective signal which is below a respective predefined threshold, with a remaining portion of the signal being unchanged by the wind-noise-reduction processing.

7. The method of claim 6 wherein the sub-band threshold (s) applied in the first stage is in the range of 300 Hz-10 kHz.

8. The method of claim 6 wherein the sub-band threshold applied in the second stage is in the range of 100 Hz-5 kHz.

9. The method of claim 1 wherein wind noise reduction is effected in the first stage by taking a weighted sum of the two signals arising from the first side of the stereo environment, wherein the weighting is determined in a manner that the signal having least signal power is weighted more heavily.

10. The method of claim 1 wherein the wind noise reduction is selectively disabled when it is determined that little or no wind noise is present.

11. A device for wind noise reduction, the device comprising:

at least one first side microphone for generating a first side input signal;

at least one second side microphone for generating a second side input signal, the first and second sides each being one of a left side and a right side;

a first stage of signal processing circuitry comprising:

a first band selector for splitting the first side input signal into a first sub-band below a spectral threshold $N_A$ and a second sub-band above the spectral threshold $N_A$;

wind noise reduction circuitry for processing the first sub-band of the first side input signal to produce a wind noise reduced first sub-band of the first side input signal; and a first sub-band combiner for recombining the wind noise reduced first sub-band of the first side input signal with the second sub-band of the first side input signal, to produce a wind noise reduced first side input signal;

a second stage of signal processing circuitry comprising:

a second band selector for splitting the wind noise reduced first side input signal into a third sub-band below a spectral threshold $N_B$ and a fourth sub-band above the spectral threshold $N_B$;

a third band selector for splitting the second side input signal into a third sub-band below the spectral threshold $N_B$ and a fourth sub-band above the spectral threshold $N_B$;

a second mixer for mixing the third sub-band of the first side input signal with the third sub-band of the second side input signal to produce an aggregate third sub-band signal having reduced wind noise;

a second sub-band combiner for combining the aggregate third sub-band signal with the fourth sub-band of the first side input signal to produce an output first side input signal; and a third sub-band combiner for combining the aggregate third sub-band signal with the fourth sub-band of the second side input signal to produce an output second side input signal, and wherein $N_B$ is less than $N_A$.

12. The device of claim 11, wherein the signal for the second side is a wind noise reduced second side signal produced as part of the first stage.

13. The device of claim 11, wherein the second stage comprises a leaky integrator configured to, when changes are required to the mixing of the third sub-band of the first side input signal with the third sub-band of the second side input signal, smooth such changes to avoid audible artefacts.

14. The device of claim 11 further comprising:

one or more microphones positioned on the first side of the stereo environment for receiving a secondary first side signal;

a fourth band selector for splitting the secondary first side signal into a first sub-band below the spectral threshold $N_A$ and a second sub-band above the spectral threshold $N_A$;

a third mixer for mixing the first sub-band of the first side input signal with the first sub-band of the secondary first side signal to produce an aggregate first sub-band signal having reduced wind noise; and a fourth sub-band combiner for combining the aggregate first sub-band signal with the second sub-band of the first side input signal to produce the wind-noise-reduced first side signal.

15. The device of claim 11 further comprising one or more microphones positioned on the second side of the stereo environment for receiving a secondary second side signal in order to effect wind noise reduction in the second side input signal in the first stage.

16. The device of claim 11, wherein the first stage and second stage are configured to apply the wind noise reduction processing only to a spectral portion of the respective signal which is below a respective predefined threshold, with a remaining portion of the signal being unchanged by the wind-noise-reduction processing.

17. The device of claim 16, wherein the sub-band threshold(s) applied in the first stage is in the range of 300 Hz-10 kHz.

18. The device of claim 16, wherein the sub-band threshold applied in the second stage is in the range of 100 Hz-5 kHz.

19. The device of claim 11, wherein the wind noise reduction circuitry is configured to effect wind noise reduction in the first stage by taking a weighted sum of the two signals arising from the first side of the stereo environment, wherein the weighting is determined in a manner that the signal having least signal power is weighted more heavily.

20. The device of claim 11, wherein the wind noise reduction circuitry is configured to selectively disable the wind noise reduction when it is determined that little or no wind noise is present.

* * * * *